United States Patent [19]

Rubarth

[11] Patent Number: 4,759,699

[45] Date of Patent: Jul. 26, 1988

[54] PLASTIC CUP HOLDER FOR FLAMING CANDLE

[76] Inventor: Wesley B. Rubarth, 8734 B Cleta St., Downey, Calif. 90241

[21] Appl. No.: 44,764

[22] Filed: May 1, 1987

[51] Int. Cl.[4] ..... F23D 3/16

[52] U.S. Cl. ..... 431/291

[58] Field of Search ..... 431/289, 291, 292, 295, 431/296; 362/161

[56] References Cited

U.S. PATENT DOCUMENTS

| | | | |
|---|---|---|---|
| 1,945,953 | 2/1934 | O'Connell | 431/291 |
| 2,072,692 | 3/1937 | Valle | 362/161 |
| 2,713,256 | 7/1955 | Oesterle et al. | 431/291 |
| 3,303,610 | 2/1967 | Erbguth | 431/289 |
| 3,547,569 | 12/1970 | Fenton et al. | 431/295 |
| 3,767,355 | 10/1973 | Anderson | 431/295 |

*Primary Examiner*—Margaret A. Focarino

*Attorney, Agent, or Firm*—Dominick Nardelli

[57] ABSTRACT

A hydrocarbon plastic candle holder is disclosed having an outwardly extending conical side wall. The bottom of the holder has a centrally located recess in which the candle fits so that the candle is centrally disposed to the conical side wall. Within the centrally located recess there is formed a concentric annular ridge to retain candles of a smaller diameter. Within the annular ridge is formed at least the three upwardly extending protrusions on which the smaller diameter candles rest so that an air space is provided under the candle.

3 Claims, 1 Drawing Sheet

PLASTIC CUP HOLDER FOR FLAMING CANDLE

BACKGROUND OF THE INVENTION

1. Field of the Invention

This invention relates to a candle holder and more particularly to a cup-shaped holder made of a hydrocarbon plastic material so that the candle can be burned while disposed within the cup.

2. Description of the Prior Art

In the past, cups in which burning candles are placed have been made of a ceramic or vitrious material which is transparent to visual light rays. Common glass is and was a good material out of which one would make the cups. Although common glass may be sensitive to rapid changes in temperature, the glass would not burn or melt because of the heat from the burning candle. Therefore, glass cups, up to now, have been an ideal material for most cup-shaped candle holders. However, molding glass vessels is a relatively expensive process when one compares it with the process of extruding or molding plastic cups.

SUMMARY OF THE INVENTION

1. Statement

The present invention teaches a novel shape for a cup, that is to be made out of plastic so that the flame from the candle does not burn or melt the plastic even when the candle burns out. The annular side wall of the cup is made conical with the larger diameter disposed upward. The smaller diameter of the side wall is closed with a disk that is made integral with the annular wall. The disk forms the bottom of the cup. The internal surface of the bottom has one or more projections protruding upward to support the candle whereby the bottom of the candle is supported above the the internal surface of the bottom disc. This allows the candle to burn until it extinguishes itself without the heat therefrom affecting the plastic. To hold the candle evenly away from the annular wall an annular step is provided around the interior surface of the bottom whereby the step surrounds the candle whenever the candle is being held within the cup. The conical wall is believed to control convention currents so that the colder air as needed to support combustion flows evenly along the interior surface of the annular wall keeping the plastic cool. To accommodate candles of smaller diameters a circular upward extending ridge is placed concentric within the annular step.

2. Objects

A primary object of this invention is to provide an improved clear transparent plastic cup for containing a burning candle.

Another object of this invention is to provide a transparent plastic cup that is heat resistant.

Another object of this invention is to provide a plastic cup which controls air currents so that cool air only makes contact with the plastic.

DESCRIPTION OF THE PREFERRED EMBODIMENT

Figure 1:
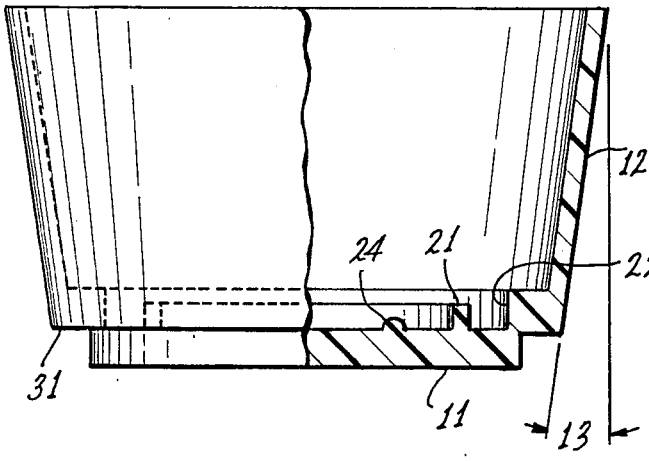
FIG. 1 is a fragmentary sectional elevational view showing one embodiment of a cup according to this invention.

Referring to FIG. 1, in particular, there is depicted my novel candleholder in partial section. The holder is cup-shaped having a disk-like base 11 and a conical wall 12 made integral with the base 11. The diameter of wall 12 increases as the height increases as measured above the base 11. I have found that in my invention the wall 12 should make an angle 13 between 3 degrees and 10 degrees with the vertical axis thereof. An angle less than 3 degrees does not function correctly and an angle of more than 10 degrees forms a cup with too large a diameter which defeats the purpose of having a cup.

Protruding upward from and into the interior of the base 11 is a means in the form of a ring or ridge 21 whose function will be described hereinafter. Around the periphery of the base 11 is formed an annular step or shoulder 22, as shown, whose function will also be described hereinafter. Within ring 21 are formed preferably three knobs 24 for reasons that will become apparent hereinafter.

Figure 4:
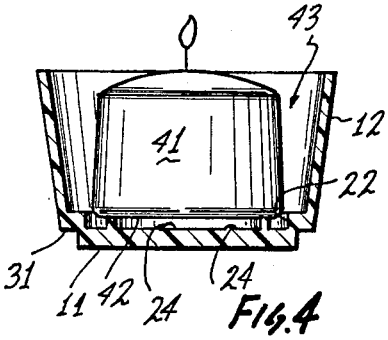
FIG. 4 is an elevation cross-section of the cup showing one type of candle mounted therein.
Figure 2:
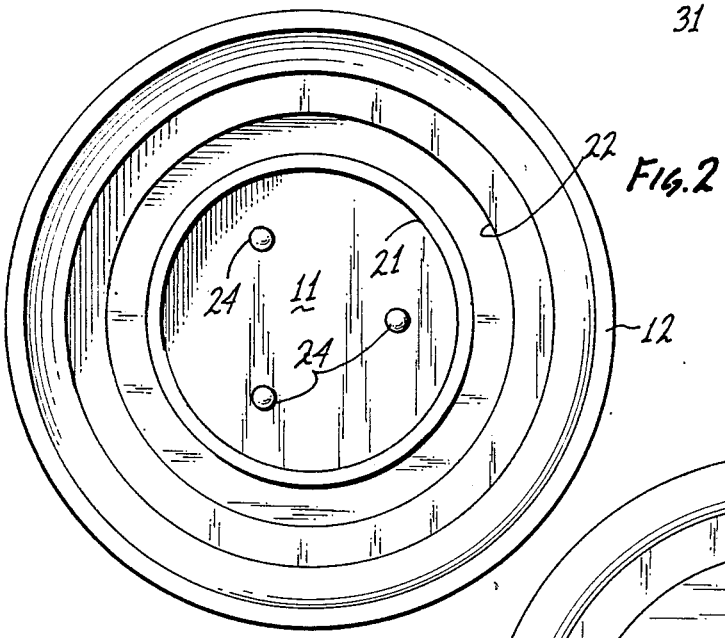
FIG. 2 is a top view of the cup shown in FIG. 1.
Figure 3:
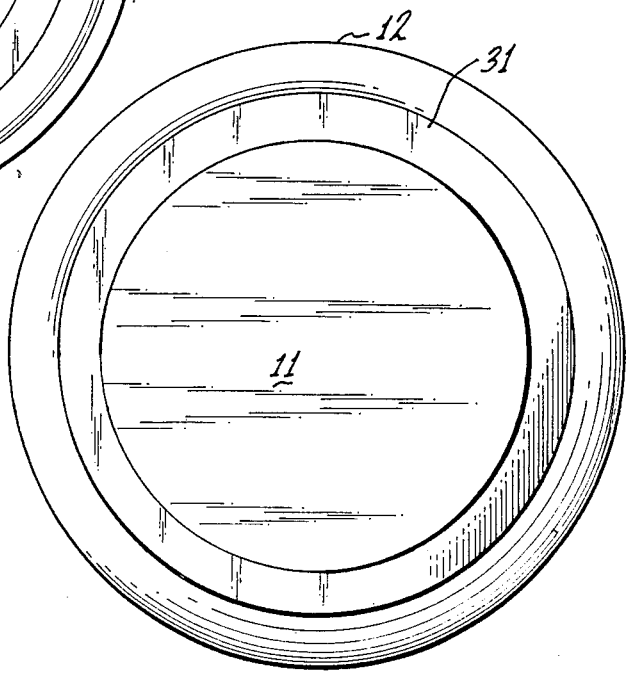
FIG. 3 is a bottom view of the cup shown in FIG. 1.

As mentioned above the purpose of this invention is to provide a candle holder that can function even though it is made of a plastic material. Therefore, when one type of a candle 41 is disposed within the holder, as shown in FIG. 4, the base or bottom of the candle is supported by the ring 21, but within the annular step 22 leaving an air space 42 and therefore forming an insulating layer. The candle is centered by the step or shoulder 22 leaving an annular air space 43 between the candle and the wall 12 so that the heat from the candle is capable of forming conventional air currents and in turn the side wall is continuously cooled. However, when another type of candle (not shown) which has a diameter smaller than candle 41 that candle would be nested within ring 21 and rest on the three knobs 24. Thereby ring 21 performs the same function for the smaller diameter candles as step 22 performs for the larger diameter candles.

Normally the candle holder is disposed within a plastic decorative item to give the effect of a light source. Therefore, to prevent the holder from sliding around within the decorative item the bottom of the base 11 is provided with an annular ridge 31 so that the lower portion of the base 11 is capable of being disposed within an annular recess for stability.

I claim:

1. In a candleholder for a candle, the combination comprising:

a circular base;

a conical wall fixed to said base;

said base having an upper planar surface disposed within said conical wall;

said base having an annular step circumscribing said upper planar surface;

a first upward extending means disposed on said upper planar surface and within said annular step to keep said candle supported and spaced above said planar surface to provide an air space therebetween;

a second upward extending means disposed on said upper surface and within said first means;

said second means having a height measured from said upper surface which is less than the height of said first means;

said first means having a height measured from said upper surface which is less than the height of said annular step;

said first means further having an annular ring disposed on said upper planar surface and within said annular step; and said second means further having at least three knobs disposed on said upper surface and within said annular ring.

2. In the combination of claim 1 wherein:

said conical wall is disposed with its largest diameter disposed remote of said base.

3. In the combination of claim 2 wherein:

the angle of said wall makes with the axis thereof is no less than 3 degrees and no more than 10 degrees.

* * * * *